US006187119B1

(12) United States Patent
Cerato

(10) Patent No.: US 6,187,119 B1
(45) Date of Patent: Feb. 13, 2001

(54) PROCESS FOR THE PREPARATION OF AN ALLOY OF GOLD AND THE ALLOY PRODUCED BY THE PROCESS

(75) Inventor: Silverio Cerato, Mussolente (IT)

(73) Assignee: Silmar S.p.A., Vicenza (IT)

( * ) Notice: Under 35 U.S.C. 154(b), the term of this patent shall be extended for 0 days.

(21) Appl. No.: 09/094,271

(22) Filed: Jun. 9, 1998

Related U.S. Application Data

(63) Continuation-in-part of application No. 08/654,357, filed on May 28, 1996, now abandoned.

(30) Foreign Application Priority Data

Jun. 27, 1995 (IT) ..... VI95A0105

(51) Int. Cl.[7] ..... C22F 1/14
(52) U.S. Cl. ..... 148/678; 148/538
(58) Field of Search ..... 148/538, 553, 148/430, 678; 420/507, 511, 512

(56) References Cited

U.S. PATENT DOCUMENTS 1,023,334 * 4/1912 Rossi ..... 420/507

* cited by examiner

*Primary Examiner*—Sikyin Ip
(74) *Attorney, Agent, or Firm*—Bucknam and Archer

(57) ABSTRACT

A process for the production of an alloy based on gold, the titer of gold being between 8 and 22 karats, comprises three phases. In the first phase, copper and titanium are subjected to fusion forming a first fused product. In the second phase, the metallic product obtained in the first phase is fused with the other components of the alloy, including silver and zinc, except gold, and in the third phase, the metallic product obtained in the second phase is fused with gold. The alloy is free of nickel and cobalt and may contain other elements in small amounts such as silicon, boron, indium, iridium and ruthenium. The amount of titanium at the most is 1%.

3 Claims, No Drawings

PROCESS FOR THE PREPARATION OF AN ALLOY OF GOLD AND THE ALLOY PRODUCED BY THE PROCESS

The present application is a Continuation-in-Part of U.S. Ser. No. 08/654,357 filed May 28, 1996, now abandoned.

FIELD OF THE INVENTION

The present invention relates to a process for the production of alloys based on gold and an alloy based on gold used in the jewelry field with a titer of gold which varies between 8 and 22 Karats and which contains various percentages of other components among which silver, copper and zinc.

BACKGROUND OF THE PRIOR ART

It is known that pure gold is extremely soft while in the production of jewelry products there is required a material which offers particular properties of hardness, resistance to wear and at the same time which maintains a warm and brilliant color.

The hardness of an alloy based on gold depends both on phenomena of precipitation in the solid phase and also on phenomena of transition of disorder/order which occur below certain temperatures and for determined atomic ratios between the elements of the alloy, a property which in particular is achieved during the thermal hardening treatment. It is actually during this thermal treatment that titanium becomes a determining factor, because while it participates to the phenomena of precipitation mentioned hereinabove, it also provides new properties to the alloy of which is a component.

The alloys based on gold in general are made starting from the ternary system Au—Ag—Cu and commercially they are available with different titers of gold varying between 8 to 24 Karats. There are also commercially available intermediate amounts of alloys, specifically with 9, 10, 12, 14, 18, 20, 21 and 22 Karats.

Up to very recent times the study of gold, a metal used for centuries for ornamental purposes, particularly for its color and its resistance to staining, has been limited to alloys which are easily workable and which have a brilliant color. With the increase in the price of gold the necessity of using jewelry lighter in weight but also resistant has become very significant. In addition, in the case of more showy articles, particularly hollow bracelets, earrings in the form of a circle and very recently the production of very thin chains similar for instance to the products listed in the Italian application number 95A000085 in the name of the same applicant as the present application, there are required products which are lighter in weight and resistant for reasons not only economical but also aesthetic in appearance.

This requirement has necessitated that other metals in the pure state be added to the three elements Au—Ag—Cu.

The metal which to a greater extent is present to form the quaternary alloy on the base of gold is zinc which is added in small amounts, less than 0.5% as a deoxidizing agent or in greater amounts up to 10% or even more when it is necessary to modify the color, the work-ability and the mechanical properties. The system of alloys of gold, silver, copper and zinc (Au—Ag—Cu—Zn) comprises almost all the gold alloys commonly used for the production of jewelry articles. These alloys may be different one from the other due to the addition to the four elements of small percentages of other metals such as nickel (Ni), cobalt (Co), iron (Fe), silicon (Si), boron (B), ruthenium (Ru), iridium (Ir), indium (In) etc. By way of example patents which demonstrate what has been mentioned hereinabove and which are characterized by the fact that they offer a variety of components which contribute to form an alloy based on gold are:

U.S. Pat. No. 2,141,157 in the name of Peterson contains 33% up to 84% of gold, 10% up to 67% of copper, between 2% up to 10% of zinc, between 2% up to 10% of silver and between 0.1% up to 5% of cobalt. In this alloy cobalt is used to obtain a reversible hardening.

U.S. Pat. No. 2,229,463 in the name of Leach contains 35% up to 75% of gold, between 5% up to 25% of silver, between 12% up to 35% of copper, between 0.1% up to 12% of zinc and between 1% up to 5% of iron. In this alloy iron is used to obtain both a reversible and irreversible hardening.

U.S. Pat. No. 2,248,100 in the name of Loebich contains between 33% up to 66% of gold, between 1% up to 30% of silver, between 10% up to 55% of copper, between 0.5% up to 15% of zinc and between 0.1% up to 5% of iron.

U.S. Pat. No. 3,981,723 describes an alloy of gold which contains palladium, silver, indium and 0.005% of iridium or ruthenium.

More recently the alloys described in U.S. Pat. No. 5,180,551 in the name of Leach & Garner and U.S. Pat. No. 5,173,132 in the name of Solomon utilize different percentages of combinations of cobalt and nickel for the purpose of improving substantially the grain structure, to improve the color and increasing the mechanical systems.

As shown in the above list of patents the titanium (Ti) element has not been used because the working of alloys containing titanium requires particular measures due to the substantial reactivity at the high temperatures with air, oxygen, nitrogen and carbon, the nitrides and carbides which are commonly present in forming the protective atmosphere during the treatments of solubilization, of aging, cold working, fusion and others.

As an element of gold alloy titanium is present at the present state of the art in the production of unfinished products used in the industry, in particular in the industry of electronic components such as Japanese J5 9107-043-A, Russian RU 2012605-C1, German publication DD-145-183 or for the production of the gold alloy usually called "white gold" as described in Japanese publication JO 3130-334-A which offers, however, physical properties substantially different from the usual ternary and quaternary gold alloys.

As an element of gold alloy used in jewelry, titanium is present according to the present state of the art only in the well known gold alloy called "gold 990". The gold alloy 990 is an alloy having high Karats which originated as a result of a study in the 1970 period and which was intended to solve two problems, hardening an alloy with a very low percentage of alloying element and at the same time producing an alloy which satisfied aesthetic criteria such as color. The result has been an alloy with 23.76 Karats of gold and 1% of titanium by weight which offered a resistance to wear compared with an 18 Karats alloy claimed in particular in U.S. Pat. No. 1,023,334 and patent P35.02 914.5. Titanium in addition is present in the form of titanium nitride in the treatment of superficial hardening to increase resistance to wear and abrasion of jewelry articles having high Karats (see A. R. Zielonka Gold Technology, November 1994).

SUMMARY OF THE PRESENT INVENTION

An object of the present invention consists of describing a process for the production of alloys based on gold and containing between 8 Karats up to 22 Karats, using as a starting material the ternary system Au—Ag—Cu and also in addition to the three elements, gold, silver and copper, may also contain other elements such as zinc, ruthenium, iridium, boron, silicon, indium, etc. and titanium in the maximum amount of 1%.

In addition, in the type of alloys in the present invention titanium substitutes two elements which up to the present time have been employed in the production of jewelry items and, specifically, nickel and cobalt, which have the drawback of being ferromagnetic. This means that the sale of jewelry in the market in which there are some regulations with respect to the sale of jewelry items which contain nickel and cobalt is limited.

In addition, nickel as it is well known may cause serious allergy forms to the skin so that in several countries, for instance, Japan, England and Germany, laws have been made which prevent the commercialization of jewelry items containing nickel.

The process according to the present invention is characterized by the fact that the operation of fusion of the different components to obtain the gold alloy is carried out according to such a manner that three different phases of fusion are carried out. Specifically, in the first phase the fusion of copper and titanium is carried out thus obtaining a first fused product.

In the second phase the fusion of the metallic product obtained in the first phase with the other components of the alloy except gold is carried out.

In the third phase the fusion of the product obtained in the second phase which is called "prelega" with gold is carried out thus obtaining the final gold alloy.

In operation, during the fusion process one must keep in mind the high degree of oxidation of the "prelega" due to the presence of titanium at high temperature.

For this purpose there is used equipment which insures total protection of the fusion bath by using inert gases such as nitrogen and argon or material having a slight reducing action by mixing the material with small amounts of hydrogen. Another possibility is to carry out the fusion in vacuo.

The gold alloy thus prepared is very suitable for the hardening treatment so that one obtains a product which is hardened and which exhibits mechanical properties substantially superior to the properties of the known ternary or quaternary alloys, a fact which is due to the presence of titanium which is inserted in the alloy in the manner as described and which diffuses itself in the crystalline structure homogenously.

By way of example alloys based on gold made according to the process of the present invention contain 58.5% of gold, between 5% and 10% of silver, between 15%–25% of copper, between 10% and 20% of zinc and between 0.1% up to 1% of titanium. These alloys have a breaking load of 35 N, resistance to traction of 53 N/mm2, a superficial hardness of 160 HV with the annealing treatment 280 HV with the aging treatment. These alloys further have a grain dimension of 8 ASTM and a stretching limit stretching limit of 78% and have a pleasant color similar to an alloy of 18 Karats which is the alloy mostly used. laboratory tests which have been carried out prove that the alloys based on gold made with the process according to the present invention and devoid of nickel and cobalt with a small amount of titanium, at the most 1%, offer superior mechanical properties in the amount of 30% with respect to alloys based on gold presently being manufactured. Obviously the specific amounts of each pure metallic element expressed in percentages by weight may vary as a function of the particular applications.

What is claimed is:

1. A process for the production of an alloy based on gold, the titer of gold being between 9 and 22 karats, which comprises steps of: providing the gold based alloy consisting essentially of silver, copper, titanium, zinc, and balance gold and inevitable impurities and free of cobalt and nickel; fusing the gold based alloy in three phases: in the first phase, subjecting the copper and titanium to fusion thereby forming a first fused metallic product, the amount of titanium being 0.1–1 wt. %; in the second phase, the metallic product obtained in the first phase is fused with silver, copper, and zinc, except gold to obtain prelega; and in the third phase, the metallic product obtained in the second phase, the prelega, is fused with gold.

2. A process for the production of an alloy based on gold, the titer of gold being between 9 and 22 karats, which comprises steps of: providing the gold based alloy consisting essentially of silver, copper, titanium, zinc, small amounts of at least one of silicon, boron, indium, iridium, and ruthenium and balance gold and inevitable impurities, and free of cobalt and nickel; fusing the gold based alloy in three phases: in the first phase, copper and titanium to fusion thereby forming a first fused metallic product, the amount of titanium being 0.1–1 wt. %; in the second phase, the metallic product obtained in the first phase is fused with silver, copper, and zinc, except gold to obtain prelega; and in the third phase, the metallic product obtained in the second phase, the prelega, is fused with gold.

3. The process according to claim 1 which is carried out in the presence of nitrogen or argon or in vacuo.

* * * * *